US006868760B1

(12) United States Patent
Johnson

(10) Patent No.: US 6,868,760 B1
(45) Date of Patent: Mar. 22, 2005

(54) TOOL LOCKING MECHANISM

(75) Inventor: Robyn Marie Johnson, Naugatuck, CT (US)

(73) Assignee: Pratt-Read Corporation, Bridgeport, CT (US)

( * ) Notice: Subject to any disclaimer, the term of this patent is extended or adjusted under 35 U.S.C. 154(b) by 15 days.

(21) Appl. No.: 10/366,022

(22) Filed: Feb. 12, 2003

(51) Int. Cl.[7] ..... B25B 23/00

(52) U.S. Cl. ..... 81/440; 81/439; 81/177.4; 81/177.6; 30/161

(58) Field of Search ..... 81/440, 439, 177.4, 81/177.6, 490; 30/161, 156–157, 159; 403/84, 103, 324, 157

(56) References Cited

U.S. PATENT DOCUMENTS 4,541,175 A * 9/1985 Boyd et al. ..... 30/161
4,699,030 A 10/1987 Yang
4,750,267 A * 6/1988 Boyd ..... 30/161
5,146,815 A 9/1992 Scott, III
5,320,004 A 6/1994 Hsiao
5,450,774 A 9/1995 Chang
5,495,942 A 3/1996 Izhak
5,581,834 A 12/1996 Collins
5,711,042 A 1/1998 Chuang
5,768,960 A * 6/1998 Archuleta ..... 403/84
5,970,553 A 10/1999 Lin
5,970,828 A * 10/1999 Bondhus et al. ..... 81/440
6,128,981 A 10/2000 Bondhus et al.
6,286,168 B1 9/2001 Woodruff et al.
6,397,709 B1 6/2002 Wall

* cited by examiner

*Primary Examiner*—Debra S. Meislin
(74) *Attorney, Agent, or Firm*—Jack C. Munro

(57) ABSTRACT

A tool instrument which has a plurality of elongated tools mounted within a housing. Each tool is separately movable relative to the housing between a retracted position located within the housing and an extended position projecting outwardly from the housing. The normal at-rest position for each of the tools is in a locked position relative to the housing. Manually pushing onto a button will cause a shaft to be moved to disengage the tools and permit the tools to be moved relative to the housing.

12 Claims, 2 Drawing Sheets

TOOL LOCKING MECHANISM

BACKGROUND OF THE INVENTION

1. Field of the Invention

This invention relates to a tool instrument which includes a plurality of elongated tools with these tools being movable between a retracted position and an extended position with usage of the tool to occur when in the extended position.

2. Description of the Related Art

Tradesmen and homeowners at times have need to use an elongated tool. A typical elongated tool would be a screwdriver, an Allen key or any similar like tool. These tools come in different sizes. In the past, a homeowner or tradesman had to have each size tool at his or her disposal. This would mean that there has to be available several different tools with there being a separate tool for each size tool.

In the past, it has been known to combine a plurality of elongated tools, such as screwdrivers or Allen keys within a single housing forming an instrument. This arrangement is particularly desirable as it provides a compact structure which can be readily carried in a tool box, glove compartment of an automobile, desk, kitchen drawer or even in a user's pocket. The user will be able to quickly extract the instrument and effect movement of a particular tool relative to that instrument so that that tool will project to an operating position and then the tool to be used by the user to perform mechanical repairs, electrical repairs or adjustments. Typical adjustments would be in conjunction with fasteners, such as a screw.

In the past, these instruments require that the outwardly projected tool that is to be used is to be fixed in position by the user's hand and not fixed to the instrument housing. The free movement of the tool relative to the instrument housing in some usages makes it difficult to perform certain tasks. It would be desirable if the projected tool could be locked in place relative to the instrument. Additionally, it would be desirable if the elongated tool that is projected is capable of being locked in different projected positions which will provide to the user different positions of use. At times, a particular task requires that the tool, for convenience, be in a particular position when not being used, the tool should be in an "out of the way" storage position.

SUMMARY OF THE INVENTION

The first basic embodiment of the present invention is directed to a tool instrument locking mechanism that utilizes a housing with an elongated tool being movably mounted between a retracted position confined within the housing to an extended position extending outward from the housing. The elongated tool has an aft end with the aft end including a through opening. The through opening has a non-circular configuration. A shaft is mounted on the housing with the shaft having a circular section and a non-circular section. The non-circular section is to matingly connect with the through opening locking the tool to the shaft. The shaft is lineally movable to disconnect the noncircular section from the tool and connect the circular section with the through opening which will permit the tool to freely pivot on the shaft.

A further embodiment of the present invention is where the first basic embodiment is modified by permitting the shaft to be moved manually.

A further embodiment of the present invention is where the first basic embodiment is modified by the shaft being spring biased constantly to engage the non-circular section with the through opening.

A further embodiment of the present invention is where the first basic embodiment is modified by the non-circular section including a plurality of interconnected surfaces located in a circular pattern.

A further embodiment of the present invention is where the first basic embodiment is modified by the configuration of the through opening comprising a series of interconnected-planar surfaces located in a circular pattern.

A further embodiment of the present invention is where the first basic embodiment is modified by the extended position actually defining a plurality of separate positions each extending at a different angle from the housing.

A further embodiment of the present invention is where the first basic embodiment is modified by there being mounted a plurality of elongated tools in conjunction with the housing.

A second basic embodiment of the present invention comprises a tool which has a housing which has an internal chamber with an elongated tool being mounted within this internal chamber. The tool is movable between a retracted position confined within the internal chamber to an extended position projecting outwardly from the housing. The tool has an aft end, the aft end includes a through hole. A shaft is mounted within the through hole and extends exteriorly of the through hole. The shaft is also mounted to the housing. The improvement comprises the through hole including a first means for engagement. The shaft has a means for non-engagement and a second means for engagement. The shaft is movable to connect either the means for engagement with the second means for engagement or with the first means for engagement. With the first means for engagement connecting with the second means of engagement, the implement is locked in position relative to the housing. With the first means for engagement connecting with the means for non-engagement, the tool will be freely pivotable on the shaft.

A further embodiment of the present invention is where the second basic embodiment is modified by the shaft being lineally movable to connect the first means for engagement with either a second means for engagement or with a means for nonengagement.

A further embodiment of the present invention is where the second basic embodiment is modified by the shaft being connected to a pressable button which is to be manually actuated in order to effect the lineal movement of the shaft.

A further embodiment of the present invention is where the second basic embodiment is modified by the shaft being continuously spring biased to have the first means for engagement connect with the second means for engagement.

A further embodiment of the present invention is where the second basic embodiment is modified by the first means for engagement being a polygonal shape and the second means for engagement being also polygonal shaped.

A further embodiment of the present invention is where the second basic embodiment is modified by the tool being movable and lockable into a plurality of different positions when in the extended position.

A further embodiment of the present invention is where the second basic embodiment is modified by there actually being mounted in conjunction with the housing more than one tool.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
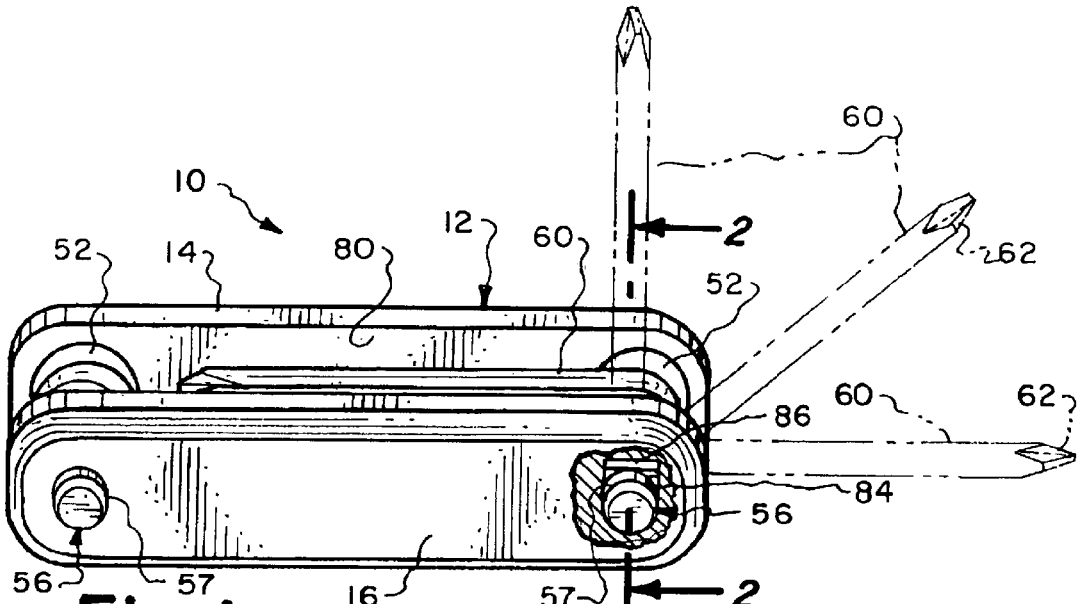
FIG. 1 is an exterior isometric view of a typical tool instrument which embodies the locking mechanism of the subject invention.
Figure 2:
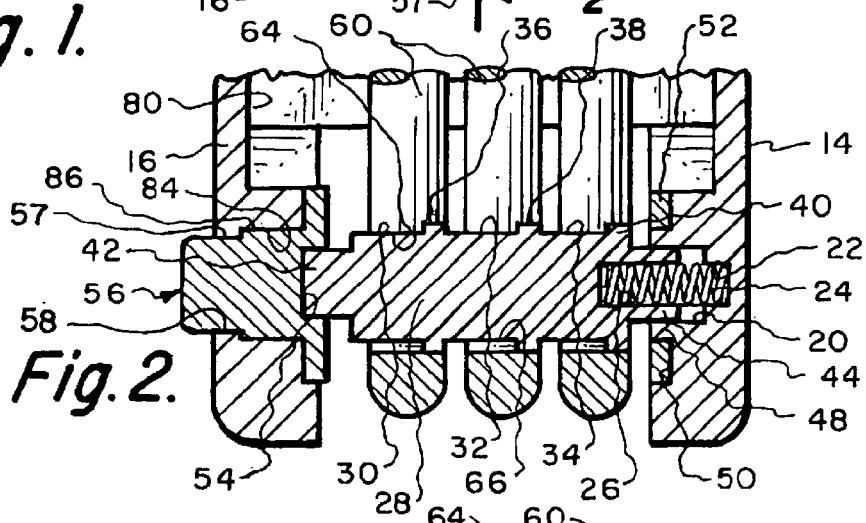
FIG. 2 is a cross-sectional view taken along line 2—2 of FIG. 1 showing the locking mechanism in the locked position.
Figure 3:
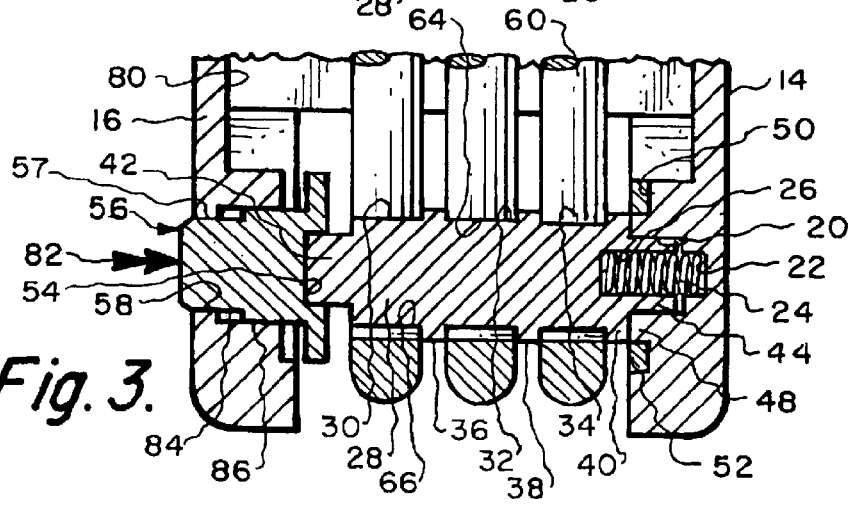
FIG. 3 is a cross-sectional view similar to FIG. 2 but showing the locking mechanism being manually moved to permit free pivoting of the tools relative to the housing of the tool instrument.

Referring particularly to the drawings, there is shown in FIG. 1 the assembled tool instrument 10 which includes the locking mechanism of this invention. The tool instrument 10 has a housing 12 with the housing 12 being formed of a pair of spaced apart housing members 14 and 16. The housing member 14 has a smoothly contoured exterior surface which is also true for housing member 16. Each of the housing members 14 and 16 are basically in the shape of thin plates which are elongated. In FIGS. 2 and 3, housing member 14, although showing square holes 18 and 20, can be any shape that produces interference and prevents shafts 28 from rotating. Similarly, housing 16 corresponds with like holes to support the opposite end of shaft 28. The constructional arrangement in association with each of the square holes 18 and 20 is identical so therefore the following description relative to square hole 20 will be applicable also to square hole 18.

Located within and connecting with the square hole 20 is a round hole 22. The round hole 22 is centrally located relative to the square hole 20. One end of a coil spring 24 is mounted within the round hole 22. The opposite end of the coil spring 24 fits within a round hole 26 which is formed within a shaft 28. It is to be understood that there is a separate shaft 28 for each coil spring 24 and for each square hole 18 and 20. The exterior surface of the shaft 28 has a plurality of non-engagement sections which is defined as circular sections 30, 32 and 34. Each circular section 30, 32 and 34 is of the same diameter although this is not mandatory. In between the circular section 30 and circular section 32 is an engagement section 36 which is basically polygonal shaped and has a plurality of interconnected planar surfaces, all of the same length, located in a circular pattern. A similar such engagement section 38 is located between the circular section 32 and 34. At the outer end of the shaft 28 there is a similar engagement section 40 that connects only with the circular section 34. All the engagement sections 36, 38 and 40 are of the same size and the same dimensions. However, again, such is not mandatory but such is preferred for ease in manufacture. The outer end of the shaft 28 is formed into a polygonal shaped protuberance 42. The inner end of the shaft 28 is formed into a polygonal shaped sleeve 44 that surrounds the round hole 26. The sleeve 44 is to matingly fit in the polygonal hole 20 that is shown square in shape. Housing member 16 is equipped with square holes 84 that connect with each hole 58 that prevent push buttons 56 from rotating when connection is made between the surfaces of each hole 84 with square surface 86 of each push button 56. Push button 56 is equipped with a square hole 87 that engages with protuberance 42 located on shafts 28 that provide support for tools 60 as well as prevent shafts 28 from rotating.

Surrounding the square hole 20 is a circular boss 48. Surrounding the circular boss 48 is an annular groove 50. A washer 52 is to be mountable within the groove 50. The round portion 57 of the push bush button 56 is mounted within a hole 58 formed within the housing member 16. It is to be understood that there are actually two in number of holes 58 with a push button 56 being mounted within each hole. A part of the round portion 57 protrudes exteriorly of the housing member 16.

Figure 4:
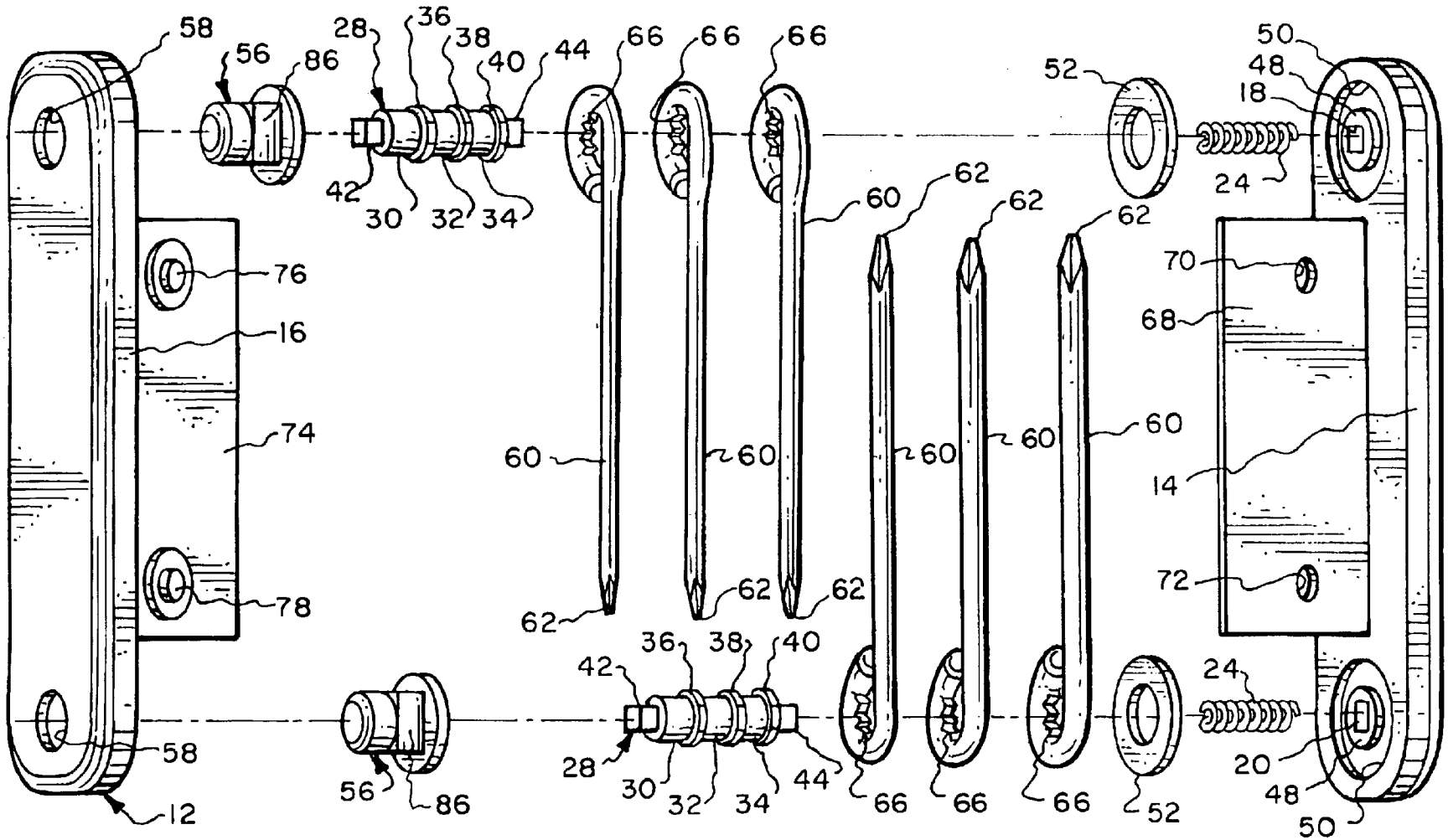
FIG. 4 is an exploded isometric view of the tool instrument that embodies the locking mechanism of the present invention.

Referring particularly to FIG. 4 of the drawings, there is shown six in number of elongated tools 60. Each tool 60 will have a head 62 that will be in a particular desired configuration, such as a screwdriver head, an Allen key or other similar type of tool head. As shown in FIG. 4, the head 62 is in the shape of a Phillips head type screwdriver head with the tools 60 ranging in size from a small screwdriver type head to a quite large screwdriver head. Each tool 60 has an inner end that is formed into a through hole 64. The through hole 64 is not circular and includes a first means for engagement in the form of a series of planar surfaces 66 arranged in a circular pattern. The first means of engagement 66 is basically of a polygonal configuration. The size and shape of the first means of engagement 66 is such that the engagement sections 36, 38 and 40 can matingly connect with the first means for engagement 66 in a locking manner.

In order to connect together into a single unit the housing members 14 and 16, there is mounted on the inner wall of housing member 14 a plate 68. Plate 68 includes a pair of spaced apart holes 70 and 72. There is also a plate 74 fixedly mounted on the inside surface of the housing member 16. Mounted on the surface of the plate 74 are spaced apart protuberances 76 and 78.

In assembling of the tool set 10 of this invention, three in number of the tools 60, forming two separate banks of tools 60, are mounted about each shaft 28 and then the sleeve 44 of each shaft is placed within a respective square hole 20. The spring has been previously mounted between the round holes 26 and 22.

The push button 56 is mounted on protuberance 42. The housing members 14 and 16 are located at its desired spatial relationship generally about one inch apart with protuberance 76 being tightly press fitted within hole 70 and protuberance 78 being tightly press fitted within hole 72. The tool instrument 10 is now formed into a single unit.

It is to be noted that three of the tools 60 point in one direction and are located parallel to each other and three of the other tools 60 are pointing in an opposite direction and also are parallel to each other. When all six of the tools 60 are located within the internal chamber 80 which is formed between the housing members 14 and 16, all the tools 60 will be essentially parallel to each other. In the normal at-rest position, each engaging section 36, 38 and 40 will connect with a first means for engagement 66 of a through hole 64. Therefore, each tool 60 is fixedly locked in position relative to the housing 12. Let it now be assumed that the user is to extract one of the tools 60 and to utilize the head 62 in conjunction with a fastener, which is not shown. Although six in number of tools 60 are illustrated in FIG. 4, any number of tools greater or less than six could be used.

In order to extract the single tool 60, the user will decide which tool from which bank of the tools 60 is desired. Once the particular bank is selected, the user will press the push button 56 in direction depicted by arrow 82 for that particular bank. When the push button 56 is pressed, the shaft 28 is lineally moved from the position in FIG. 2 to the position in FIG. 3. This will locate the engaging section 36 in the space between a pair of the tools 60, locate the engaging section 38 between another pair of the tools 60 and locate the engaging recess 40 directly adjacent the washer 50. The result is the circular section 30 is located within a through hole 64 of one tool 60 with circular section 32 being located within a through hole 64 of another tool 60 and circular section 34 connecting with a through hole of the remaining tool 60. This means that each of the tools 60 in this bank of tools is capable of being freely pivoted to any one of the dotted line positions shown in FIG. 1. However, the user will normally not remove all three implements of the bank of tools 60 although the user would be capable of doing such. Typically, the user will remove a single tool 60 and locate it in either the dotted right angled position shown in FIG. 1, the dotted obtuse position shown in FIG. 1, or the dotted straight line position shown in FIG. 1. When the desired position has been obtained, the user will release push button 56 and the bias of the spring 24 will force the shaft 28 in the left direction, which is directly opposite the pushing in direction represented by arrow 82. This will then reengage the engaging sections 36, 38 and 40 with the first means for engagement 66 of the tools 60 that are mounted on the shaft 28. This means that the tool 60 that is in the outwardly extended position, represented by the dotted lines of FIG. 1, is locked in that position. After usage of the tool 60, the user is to then push on push button 56 in the direction of arrow 82 which will permit the tool 60 to be moved back within the internal chamber 80, and when the push button 56 is released, the tool 60 is again locked in position.

What is claimed is:

1. A tool locking mechanism comprising:

a housing;

a plurality of elongated tools with each tool being separately movable between a retracted position confined within said housing to an extended position extending outward from said housing, each said tool having an aft end, each said aft end including a through opening, said through openings located side-by-side, each said through opening being non-circular in configuration; and a shaft mounted on said housing, said shaft extending through said through openings, said shaft having a plurality of circular sections and a plurality of non-circular sections with there being a circular section of said circular sections located between each directly adjacent pair of said non-circular sections, a said non-circular section being able to matingly connect with a said through opening locking said tool to said shaft, said shaft being lineally movable to simultaneously disconnect said non-circular sections from said tools and connect each said circular section with a single said through opening which will permit said tools to freely pivot on said shaft.

2. The tool locking mechanism as defined in claim 1 wherein:

said shaft being manually movable to achieve connection of said circular section with said through opening.

3. The tool locking mechanism as defined in claim 2 wherein:

said shaft being connected to a spring, said spring exerting a continuous bias on said shaft tending to locate said shaft so said non-circular section connects with said through opening.

4. The tool locking mechanism as defined in claim 1 wherein:

said non-circular section including a plurality of interconnected planar surfaces located in a circular pattern.

5. The tool locking mechanism as defined in claim 1 wherein:

said configuration of said through hole comprising a series of interconnected planar surfaces located in a circular pattern.

6. The tool locking mechanism as defined in claim 1 wherein:

said extended position actually defining a plurality of separate extended positions each extending at a different angle from said housing.

7. In combination with a tool instrument having a housing which has an internal chamber, a plurality of implements mounted in juxtaposition within said internal chamber, each implement of said implements being movable between a retracted position confined within said internal chamber to an extended position projecting outwardly from said housing, each said implement having an aft end, each said aft end including a through hole, a shaft mounted within said through hole of all said implements, said shaft extending exteriorly of said through holes, said shaft being mounted to said housing, the improvement comprising:

each said through hole including first means for engagement; and said shaft having means for non-engagement and a second means for engagement, said shaft being movable to connect said first means for engagement with either said means for non-engagement or said second means for engagement, with each said first means for engagement connecting with said second means for engagement all of said implements being locked in position relative to said housing, with each said first means for engagement connecting with said means for non-engagement all of said implements being freely and separately pivotable on said shaft.

8. The combination as defined in claim 7 wherein:

said shaft being lineally movable relative to said housing.

9. The combination as defined in claim 7 wherein:

said shaft including a manually pressable push button to cause to permit the movement of said shaft.

10. The combination as defined in claim 7 wherein:

said shaft being connected to a spring, said spring being under a constant bias tending to locate said shaft so said first means for engagement connects with said second means for engagement.

11. The combination as defined in claim 7 wherein:

said first means for engagement defining a polygonal shape, said second means for engagement defining a polygonal shape.

12. The combination as defined in claim 7 wherein:

said extended position actually defining a plurality of separate positions each extending at a different angle from said housing.

* * * * *